United States Patent [19]

Huber et al.

[11] 4,042,181

[45] Aug. 16, 1977

[54] LEAD ANGLE CONTROLLING MECHANISM

[75] Inventors: Gene A. Huber, San Dimas; Jon A. Knartzer, Buena Park, both of Calif.

[73] Assignee: SWECO, Incorporated, Los Angeles, Calif.

[21] Appl. No.: 698,934

[22] Filed: June 23, 1976

[51] Int. Cl.[2] ..... B02C 17/08

[52] U.S. Cl. ..... 241/175; 51/163.1

[58] Field of Search ..... 241/153, 175, 284, 292; 51/163.1, 163.2; 74/61; 310/81; 259/DIG. 42

[56] References Cited

U.S. PATENT DOCUMENTS

| | | | |
|---|---|---|---|
| 2,852,946 | 9/1958 | Petrin | 74/61 |
| 3,091,712 | 5/1963 | Galbraith | 310/81 |
| 3,919,575 | 11/1975 | Weber et al. | 310/81 |

*Primary Examiner*—Granville Y. Custer, Jr.
*Attorney, Agent, or Firm*—Lyon & Lyon

[57] ABSTRACT

A device employed with a vibratory apparatus such as a mill or the like which is used to change the lead angle between rotating eccentric weights. Eccentric weights are mounted at either end of a drive motor and caused to rotate with the motor shaft at specific angles with respect to one another to develop a specific vibratory action. At one end, the eccentric weight is fixedly mounted on the shaft. At the other end, the weight is rotatably mounted on the shaft. A stop mechanism is associated with the shaft adjacent the rotatably mounted weight to prevent the weight from pivoting through more than a predetermined angle. By rotating the motor and shaft in a first direction, the rotatably mounted weight assumes a position on the shaft at a first stop. When the motor is reversed, the rotatably mounted weight swings to a position at a second stop. A spring is employed to bias the rotatably mounted weight against the first stop and acts to prevent damaging impact of the weight against the second stop when the motor is reversed. Provision is made for facilely varying the bias load of the spring and for quickly changing the location of the stops such that a wide variety of loads and operating conditions can be created and accomodated.

9 Claims, 7 Drawing Figures

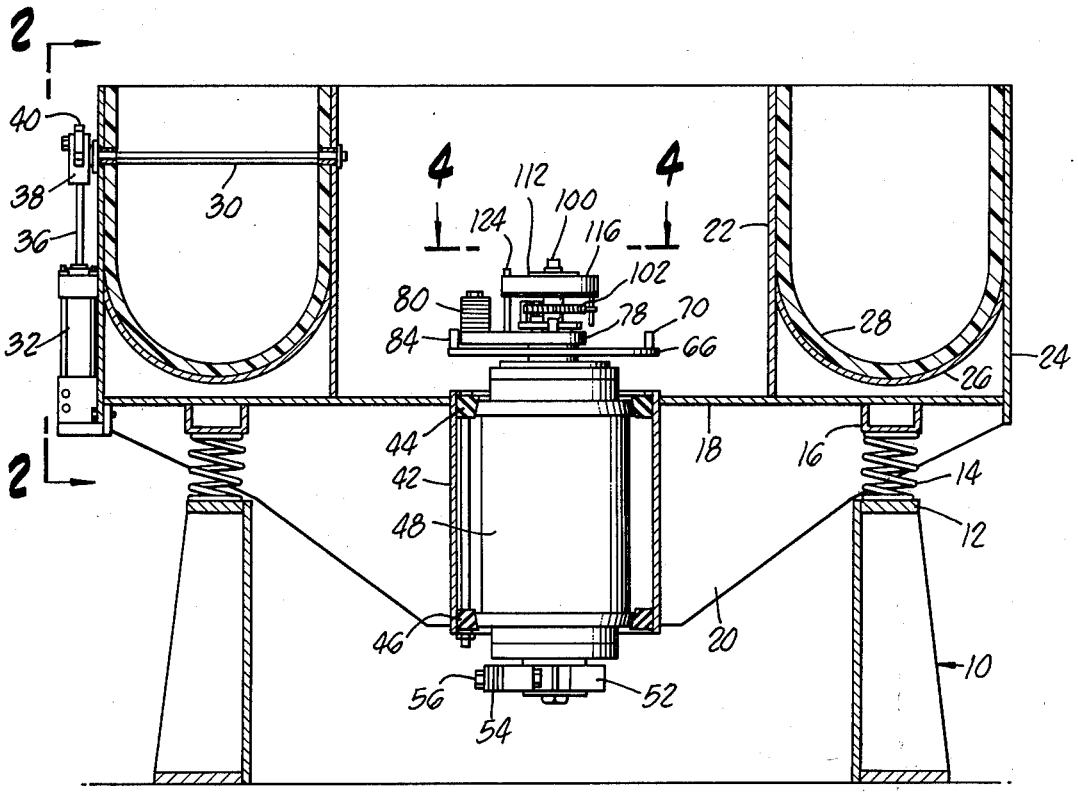
FIG. 1.
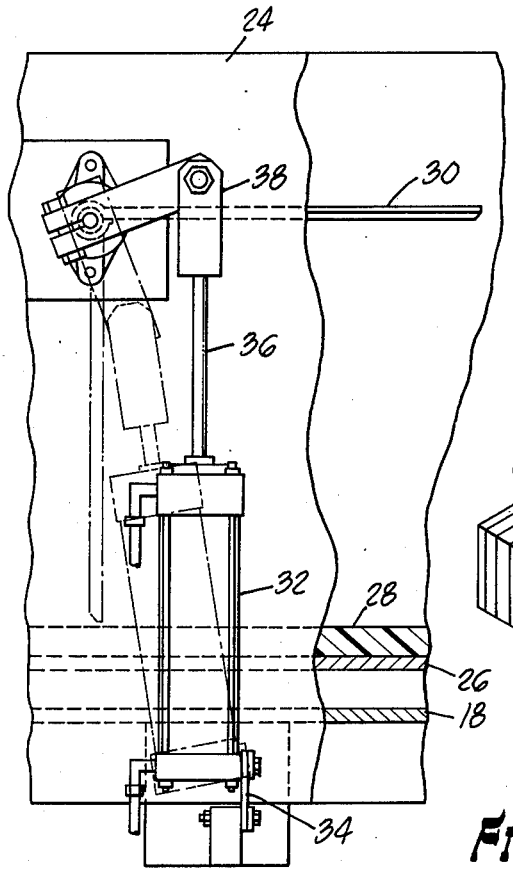
FIG. 2.
FIG. 3.
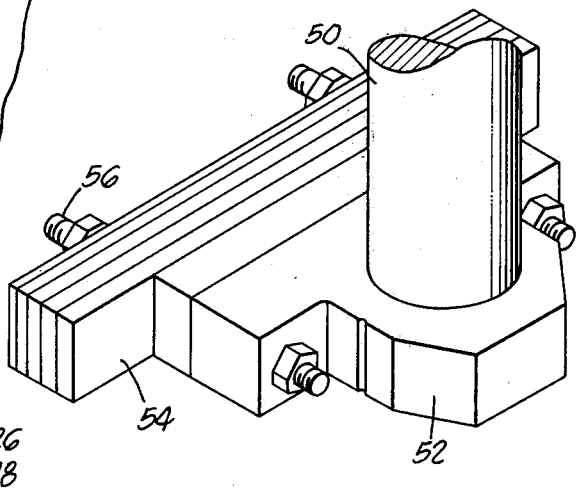

LEAD ANGLE CONTROLLING MECHANISM

BACKGROUND OF THE INVENTION

This invention is directed to an improved mechanism for controlling the lead angle between eccentric weights in a vibratory mechanism. More specifically, this invention is directed to a mechanism allowing controlled privotal movement of one eccentric weight of a dual eccentric weight vibratory system.

A number of lead angle changing mechanisms have been devised for vibratory mills and the like. One such earlier mechanism is disclosed in U.S. patent application Ser. No. 540,507, filed Jan. 13, 1975, for MOTION REVERSING SYSTEM FOR A VIBRATORY MILL, now abandoned. This earlier mechanism incorporated a reversible motor having a fixedly mounted eccentric weight on one end of the motor shaft. At the other end of the motor shaft, a rotatably mounted eccentric weight is constrained to pivot relative to the shaft only through a predetermined angle. The direction of rotation of the motor determines the position of the rotatably mounted eccentric weight within that predetermined angle.

This passive weight mounting system has worked advantageously with vibratory mills and the like to control the characteristics of the induced vibratory motion of such devices. However, in some instances, when a high torque motor has been employed with such a lead angle controlling mechanism, it has been found that over a period of time the impacting of the rotatably mounted eccentric weight on the mechanism limiting rotation has resulted in damage to the system. In this context, a means for reducing the impact loads occurring in the operation of such mechanisms was felt to be advantageous. Other, active systems have been employed to change lead angles of vibratory devices during operation. Such devices have used pneumatic systems and the like to accomplish the required lead angle change. The increased complexity of such systems is believed to be disadvantageous because of the increased possibility of system failure in such a dynamic environment and because of the increased costs.

SUMMARY OF THE INVENTION

The present invention is directed to a system for controlling the lead angle of one rotating eccentric weight relative to another in a vibration generating mechanism without subjecting the mechanism to damaging impact loads. This is accomplished in the present invention with a weight mounting system that allows controlled pivotal movement of one eccentric weight upon reversal of the drive mechanism. The controlled pivotal movement includes a biasing mechanism which prevents damaging impact of the rotatably mounted eccentric weight against the constraining mechanism. Means are also provided for allowing facile selection of new lead angle arrangements; and a mechanism is employed for varying the degree of bias force employed against the rotatably mounted eccentric weight.

Accordingly, it is a primary object of the present invention to provide an improved lead angle controlling mechanism for a rotating eccentric weight vibratory mechanism.

It is another object of the present invention to provide a lead angle controlling mechanism employing a rotatably mounted eccentric weight, the movement of which is controlled to prevent damaging impact on the mechanism.

It is yet another object of the present invention to provide an adjustable bias spring mechanism in association with a rotatably mounted eccentric weight in a vibration generating apparatus.

Other and further objects and advantages will become apparent upon a reading of the following detailed description, the drawings, and the claims.

BRIEF DESCRIPTION OF THE DRAWINGS

FIG. 1 is a cross-sectional elevation of a finishing mill taken in vertical section along a center line of the mill. The motor and eccentric weights system are not sectioned.

FIG. 2 is a detailed elevation of a finishing mill broken away and in section to illustrate placement and operation of a weir system enhanced by association with the present invention.

FIG. 3 is a prospective view showing a fixed eccentric weight system at an opposite end of the shaft from the reversing eccentric weight system.

DETAILED DESCRIPTION OF THE PREFERRED EMBODIMENT

Figure 4:
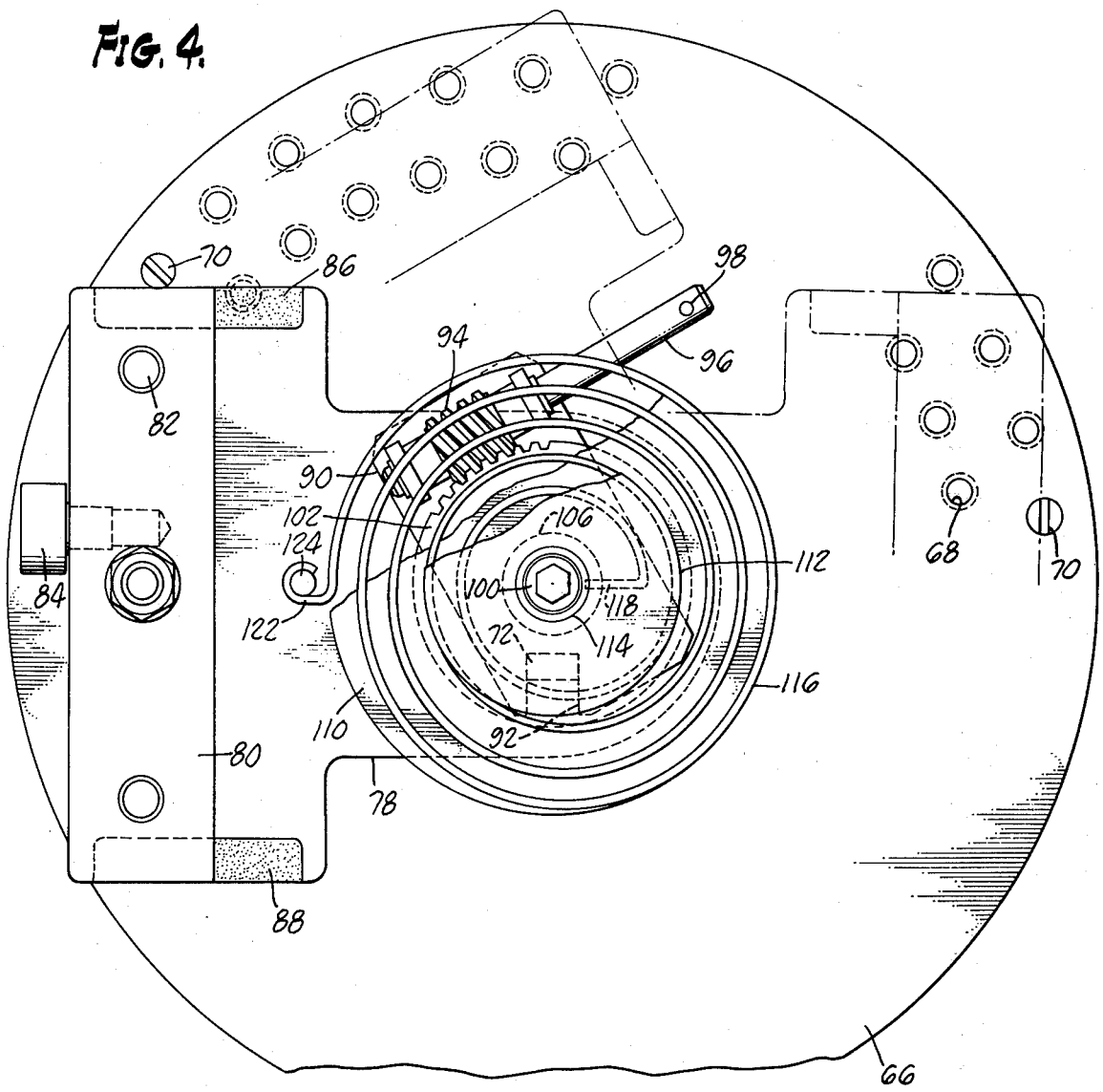
FIG. 4 is a partial top view of the upper weight assembly of the present invention with extreme positions obtainable by the weight assembly shown in phantom.
Figure 5:
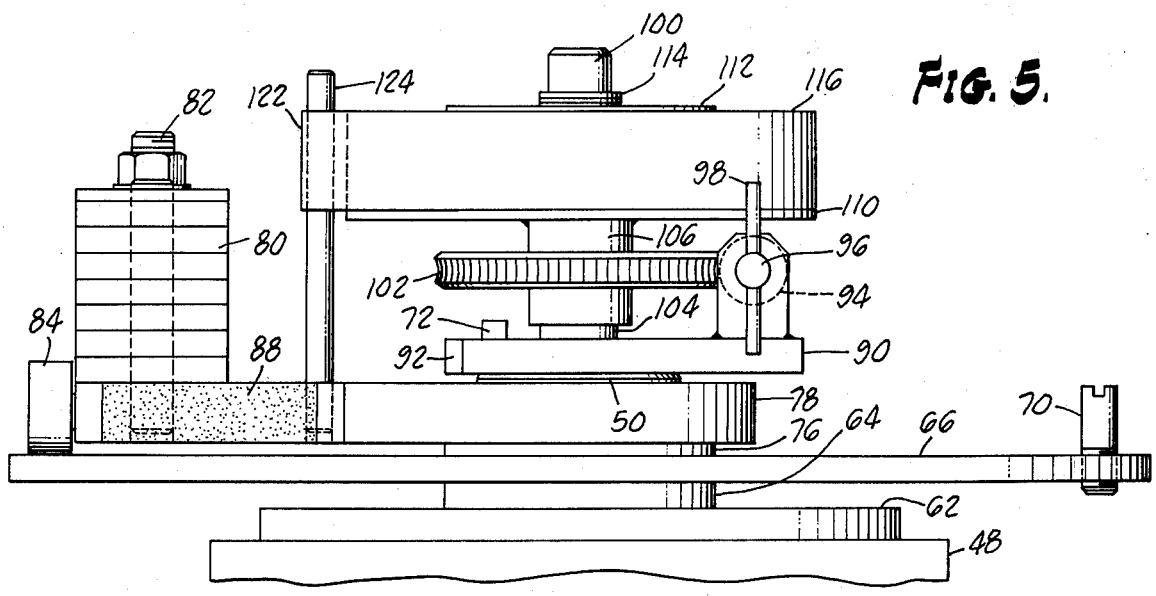
FIG. 5 is a fragmentary elevation of the upper weight assembly with the spring adjustment system rotated relative to the weight for clarity.
Figure 6:
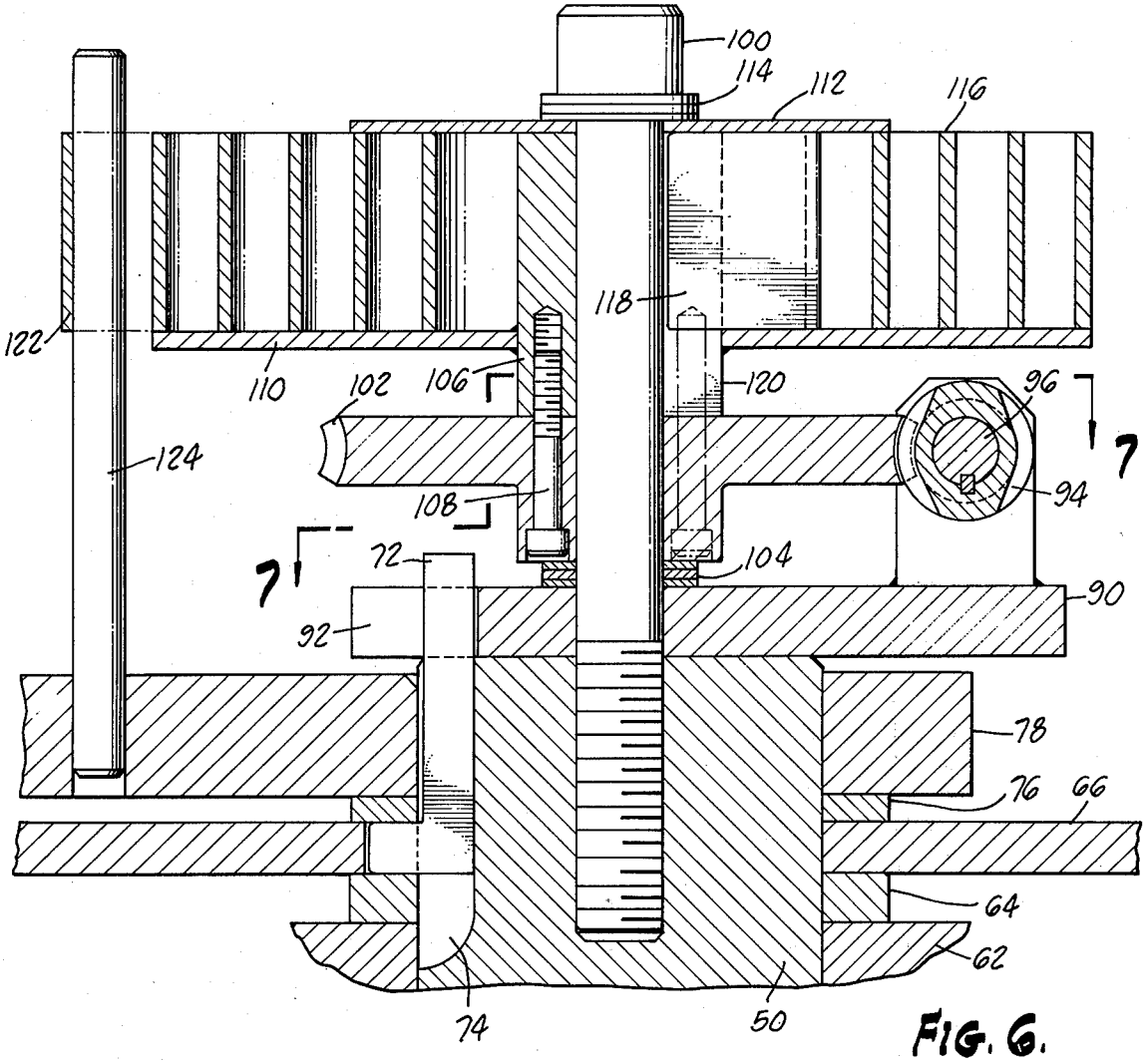
FIG. 6 is a fragmentary sectional view through the center of the upper weight assembly mechanism as shown in FIG. 5.
Figure 7:
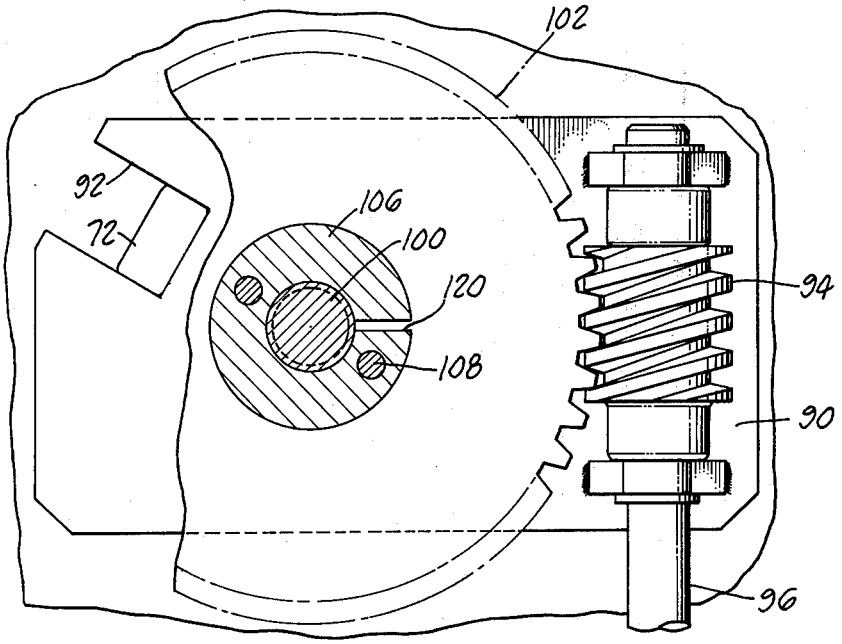
FIG. 7 is a cross-sectional plan view of a fragmentary portion of the spring adjustment mechanism of the upper weight assembly.

The lead angle controlling mechanism of the present invention is described here in association with an annular cavity vibratory mill with which the controlling mechanism is extremely useful. However, it is to be understood that the present invention is not to be limited to such an association but is to be recognized in its full utility with a wide variety of vibratory mechanisms. Furthermore, the mechanism may be mounted to a wide variety of rotating drive shafts capable of driving in both forward and reverse and not simply to the shaft of a reversible motor in the context of the description set forth herein.

Referring now to FIG. 1, a finishing mill is illustrated as including a circular base 10 having a radially extending circular mounting flange 12. The base 10 is preferably fixed to the ground by conventional anchorage means to form a stable and rigid support for the mill. The mill is resiliently mounted to the base 10 by means of a plurality of coil springs 14 affixed at one end to the circular mounting flange 12. The sprung mill is generally a welded structure mounted on the coil springs 14 at a circular channel member 16. A circular base plate 18 is in turn mounted to the circular channel member 16. The circular base plate 18 is made more rigid by radially disposed vertical gussets 20.

A central tube 22 extends upwardly from the base plate 18. An outer shell 24 also extends upwardly from the base plate 18 in coaxial alignment with the tube 22. Between the tube 22 and the shell 24 an annular space is defined. This annular space may include a formed metal bottom plate 26 which is semi-circular in cross section to help define a circular trough having vertical sidewalls and a rounded bottom. A wear resistent liner 28 lines the inner surfaces of the mill cavity.

A movable weir 30 may be pivotally mounted at either side thereof of the sidewalls of the mill cavity. In the horizontal position as shown in FIG. 2, the weir 30 allows free movement of the media and parts within the mill cavity. When disposed in the vertical position, as shown in phantom in FIG. 2, the parts and media may be driven up and over the weir by vibratory action to allow automatic unloading of the mill. An actuator assembly is mounted to the outer shell 24 to control the position of the weir 30. The actuator assembly includes a fluid cylinder which is mounted at one end to the shell 24 by a flexible bracket 34. The piston rod 36 of the fluid cylinder 32 extends to a clevis 28 which is pivotally attached to a lever 40. The lever 40 is in turn associated with the weir 30 to bring about pivotal motion thereof under the influence of the fluid cylinder 32.

At the center of the mill, a motor housing 42 is rigidly fixed in coaxial alignment with the mounting flange 12 and the overall structure of the mill. The housing 42 is held in place by the gussets 20 and extends through the bottom plate 18. Motor mounts 44 and 46 are positioned in the motor housing 42 to receive a reversible electric motor 48. The motor 48 includes a shaft 50 which extends from either end of the motor to receive the eccentric weight assembly. As previously discussed, other shaft drive mechanisms may be employed to provide reversible rotary input to the eccentric weight assemblies. However, the reversible electric motor arrangement has been found to be most advantageous.

The bottom eccentric weight assembly is generally illustrated in FIG. 3. A simple weight hanger 52 is keyed to the shaft 50. The weight hanger 52 includes a mounting bracket for mounting a number of weights 54 to the weight hanger 52 by means of common fasteners such as studs 56 illustrated in FIG. 3. A worm gear arrangement may be employed to make the weight hanger assembly adjustable relative to the shaft about a common axis. However, with the present, highly adjustable upper weight assembly, such a complicated arrangement is believed unnecessary.

Looking now to FIGS. 4 through 7, the upper eccentric weight assembly is illustrated. The upper eccentric weight assembly provides the lead angle controlling mechanism of the present invention. It is to be understood that this lead angle controlling mechanism may be either on the upper or the lower end of the motor shaft 50. However, greater structural containment of the mechanism is available at the upper end of the motor shaft 50 for added safety.

The upper eccentric weight assembly is generally supported on the bearing plate 62 of the motor about the motor shaft 50. A weight spacer 64 is positioned on the bearing plate 62 about the shaft 50 and in turn supports the indexing plate 66. The indexing plate 66 is conveniently circular and has a plurality of threaded holes 68 for receiving weight stops 70. The indexing plate 66 is keyed by means of key 72 which is positioned in a keyway 74 in the motor shaft 50. Thus, the indexing plate 66 has an established position relative to the shaft 50 and in turn the lower eccentric weight assembly. The threaded holes 68 define specific angles relative to the lower eccentric weight assembly. Therefore, the fixed indexing plate 66 and weight stops 70 provide a stop means which may be used to define specific angles relative to the lower eccentric weight.

Immediately above the indexing plate 66 is a bearing spacer 76 positioned about the shaft 50. The bearing spacer 76 supports a weight hanger 78 which is rotatably mounted on the motor shaft 50. The weight hanger 78 extends from a collar portion thereof about the shaft 50 to a bracket portion capable of receiving a plurality of weights 80. Studs 82 extend upwardly from the bracket portion of the weight hanger 78 to receive the weights 80. To prevent binding of the collar portion of the weight hanger 78 on the motor shaft 50, a roller 84 extends from the outer end of the weight hanger 78 to ride on the indexing plate 66.

As the weight hanger 78 is free to rotate about the motor shaft 50, the weight hanger 78 will pivot in an opposite direction to the direction torque is applied through the shaft 50. This rotation of the weight hanger 78 is prevented by the weight stops 70 which are advantageously positioned to achieve the optimum vibrational motion induced by both the upper and lower eccentric weight assemblies. To alleviate surface damage and in part reduce shock loading to the components of the upper eccentric weight assembly, elastomeric blocks 86 and 88 are positioned in inserts on either side of the weight hanger 78 in order that cushioned impact of the weight hanger 78 with the weight stops 70 will occur upon rotation of the weight hanger 78. The extreme positions of the weight hanger 78 are illustrated in phantom in FIG. 4. If the weight hanger 78 is allowed to proceed further, interference may result with the bias adjusting mechanism described below. If a full revolution of the upper eccentric weight assembly would be of benefit, a modified bias adjustment mechanism could obviously avoid such interference between components.

Positioned above the weight hanger 78, a worm bracket 90 is keyed to rotate with the shaft 50 by means of key 72 positioned in a keyway 92. The worm bracket 90 includes an upstanding support in which a worm 94 is rotatably mounted. A shaft 96 extends from the worm 94 to a pin handle 98 for manual adjustment of the biasing mechanism.

To hold the several components of the upper eccentric weight assembly on the motor shaft 50, a cap screw 100 extends in axial alignment with the shaft 50. The worm bracket 90 is positioned on the shaft 50 by means of the cap screw 100 and in turn prevents the weight hanger 78 from rising up over the end of the motor shaft 50.

Located on the cap screw 100 above the worm bracket 90 is a worm wheel 102. The worm wheel 102 is rotatably mounted on the cap screw 100 on a needle thrust bearing 104 and extends to engage the worm 94. The hub of the worm wheel 102 is securely fastened to a hub 106 by means of inset socket head cap screws 108. The hub 106 is also rotatably mounted about the cap screw 100. Welded to the hub 106 is a spring retainer plate 110 which extends laterally from the hub 106. Above the hub 106, a washer 112 and a second needle thrust bearing 114 cooperates with the cap screw 100 to hold the assembly in place.

To provide a biasing means on the weight hanger 78, a clock spring 116 is positioned about the cap screw 100 on the spring retainer plate 110. At the inner end of the clock spring 116, a flange 118 extends to a slot 120 in the hub 106. Thus, the inner end of the clock spring 116 is coupled through the hub 106, the worm wheel 102 and worm 94 and the worm bracket 90 to the motor shaft 50.

This coupling is adjustable through manipulation of the worm gear.

At the outer end of the clock spring 116, a hook 122 is formed to receive an elongated pin 124. The elongated pin 124 is rigidly fixed in the weight hanger 78. Thus, the weight hanger 78 may be biased by the spring 116 against one or the other of the weight stops 70. As can be seen in FIG. 4, the orientation of the spring in the present embodiment causes the weight hanger 78 to be biased in a clockwise direction. An increase or decrease in the amount of bias may be provided by employing the worm gear arrangement to rotate the hub 106 about the cap screw 100.

The cooperation between the weight hanger 78 and both the stop means and the biasing means acts to provide controlled pivotal motion of the weight hanger 78 upon reversal of the motor 48. The weight stops are positioned at preselected angles for the vibratory mill of the present invention such that longitudinal motion of the parts and media within the mill cavity may progress in different directions depending upon the direction of rotation of the motor 48. During processing, the longitudinal motion of the parts and media along the mill cavity is in a counterclockwise direction which is selected in this instance because of the orientation of weir. Counterclockwise motion will aid the weir actuator assembly to extract the weir 30. The specific lead angle employed in the processing mode is preferably set to maximize roll for proper finishing. Once processing is complete, the second lead angle is selected by reversing the motor 48. The longitudinal motion of the material within the mill will then be in a clockwise direction. The second lead angle is set for a high rate of procession in order that the material and parts will climb over the weir 30 and discharge from the mill. Furthermore, the longitudinal motion of the material in a clockwise direction will urge the weir 30 downwardly into the cavity in cooperation with the weir actuator assembly.

The upper eccentric weight assembly is designed to assume the discharge lead angle rather than the processing lead angle when at rest. This is accomplished by biasing the clock spring 116 against the stop which defines the appropriate lead angle for the discharge mode. Biasing in this direction is preferred because a mill is stopped more frequently during unloading than during processing.

When the motor is driven in a counterclockwise direction, the weight hanger 78 is driven by the weight stop 70 also in a counterclockwise direction. As this is the discharge direction for the mill, the weight hanger 78 will start out in this position. When the motor is reversed and driven in a clockwise direction, the weight hanger 78 will rotate relative to the shaft 50 until it encounters the opposite weight stop 70. The weight hanger 78 then rotates in a clockwise manner with the shaft 50.

The preload placed on the clock spring 116 is designed to provide a bias load on the weight hanger 78 which is less than the torque load produced by the motor. At the same time, the bias load is sufficient to support substantial acceleration of the weight hanger 78 such that when the weight stop 70 catches up with the weight hanger 78, the weight hanger 78 will be moving at a speed such that damage will not occur to the mechanism by the impact of the weight stop 70 on the elastomeric block 88. The worm gear allows adjustment of the biasing load to accomplish this result regardless of the number of weights on the weight hangers 52 and 78 and the size of the lead angles. When the motor is stopped, the weight hanger 78 will again resume its position in the discharge mode.

As an example of the present invention, one embodiment incorporating a 10 horsepower motor with an upper eccentric product (defined as the eccentric distance from the center of mass of the eccentric weight to the center of rotation times the weight of the eccentric mass) of from around 22 to 150 inch-pounds and a lower eccentric product of from 44 to 220 inch-pounds includes a spring having a range of torque capacity of from 0 to 150 inch-pounds.

Thus, an improved lead angle controlling mechanism is disclosed which allows for controlled pivotal motion of the weight hanger to assume either of two preselected angles. The angles as well as biasing loads on the eccentric weight assembly may be conveniently changed without dissembly of the system. While embodiments and applications of this invention have been shown and described, it would be apparent to those skilled in the art that many more modifications are possible without departing from the inventive concepts herein described. The invention, therefore, is not to be restrictive except by the spirit of the appended claims.

What is claimed is:

1. A lead angle controlling mechanism for a vibratory apparatus having a reversible shaft drive mechanism, comprising a first eccentric weight fixedly mounted to the shaft of the reversible shaft drive mechanism;

a second eccentric weight rotatably mounted to the shaft;

stop means fixed to rotate with the shaft for constraining the rotational motion of said second eccentric weight to an arc between two preselected angles relative to the position of said first eccentric weight on the shaft, said second eccentric weight thereby assuming a first position at one of said angles upon rotation of the shaft in a first direction and assuming a second position at the other of said angles upon rotation of the shaft in a second direction; and biasing means fixed to rotate with the shaft and extending to said second eccentric weight biasing said second eccentric weight toward said first position, said bias means being of sufficient strength to prevent damaging impact of said second eccentric weight against said stop means when the shaft is rotated in said second direction.

2. The lead angle controlling mechanism of claim 1 wherein said stop means includes a plate fixed to rotate with the shaft, stop positions on said plate and weight stops fixed to at least one of said stop positions on said plate, said stops interfering with the free rotation of said second eccentric weight about the shaft.

3. The lead angle controlling mechanism of claim 1 wherein said bias means includes a clock spring fixed at one end to rotate with the shaft and fixed at the other end to said second eccentric weight.

4. The lead angle controlling mechanism of claim 3 wherein said clock spring is preloaded in a first direction to force said eccentric weight to said first position when the vibratory apparatus is at rest.

5. The lead angle controlling mechanism of claim 3 further including a gear fixedly mounted to said shaft, said first end of said clock spring being fixed to said gear allowing manual adjustment of the positions of the end of said clock spring relative to the shaft.

6. A lead angle controlling mechanism included with a vibratory apparatus for inducing vibrations in the apparatus, comprising a reversible motor, said reversible motor including a drive shaft extending from each end of said motor;

a first eccentric weight fixedly mounted to said drive shaft at the first end of said motor;

a second eccentric weight rotatably mounted to said drive shaft at the other end of said motor;

stop means fixed to the shaft for constraining the rotational motion of said second eccentric weight to an arc between two preselected angles relative to the position of said first eccentric weight on the shaft, said second eccentric weight thereby assuming a first position at one of said preselected angles upon rotation of the shaft in the first direction and assuming a second position at the other of said preselected angles upon rotation of the shaft in a second direction; and biasing means fixedly mounted to rotate with the shaft and extending to said second eccentric weight biasing said second eccentric weight toward said first position, said biasing means being of sufficient strength to prevent damaging impact of said second eccentric weight against said stop means when the shaft is rotated in said second direction.

7. A lead angle controlling mechanism for a vibratory apparatus having a reversible shaft drive mechanism, comprising a first eccentric weight fixedly mounted to the shaft of the reversible shaft drive mechanism;

a second eccentric weight rotatably mounted to the shaft;

a stop mechanism fixed to the shaft to interfere with motion of said second eccentric weight for constraining the rotational motion of said second eccentric weight to an arc between two preselected angles relative to the position of said first eccentric weight on the shaft, said second eccentric weight thereby assuming a first position at one end of said arc upon rotation of the shaft in a first direction and assuming a second position at the other end of said arc upon rotation of the shaft in a first direction and assuming a second position at the other end of said arc upon rotation of the shaft in the second direction; and a clock spring fixed at one end to rotate with the shaft and fixed at the other end to said second eccentric weight, said clock spring being preloaded in a first direction to force said eccentric weight to said first position when the vibratory apparatus is at rest.

8. The lead angle controlling mechanism of claim 7 wherein said stop mechanism includes a plate fixed to rotate with the shaft, stop positions on said plate and weight stops fixed to at least one of said stop positions on said plate, said stops interfering with the free rotation of said second eccentric weight about the shaft.

9. The lead angle controlling mechanism of claim 7 further including a gear fixedly mounted to said shaft, said first end of said clock spring being fixed to said gear allowing manual adjustment of the positions of the end of said clock spring relative to the shaft.

* * * * *